US005306223A

United States Patent [19]

Martinez

[11] Patent Number: 5,306,223

[45] Date of Patent: Apr. 26, 1994

[54] ABDOMINAL EXERCISE APPARATUS

[76] Inventor: Richard J. Martinez, 325 Circle Dr., Algonquin, Ill. 60102

[21] Appl. No.: 8,149

[22] Filed: Jan. 25, 1993

[51] Int. Cl.[5] ..... A63B 23/04

[52] U.S. Cl. ..... 482/142; 482/146; 482/96

[58] Field of Search ..... 472/26, 28; 482/91, 482/70, 71, 96, 114, 146, 147, 148, 142

[56] References Cited

U.S. PATENT DOCUMENTS

| | | | |
|---|---|---|---|
| 3,021,137 | 2/1962 | Palmer et al. | 482/71 |
| 3,063,714 | 11/1962 | Krass | 482/147 |
| 3,441,271 | 4/1969 | Palacios | 482/71 |
| 3,575,412 | 4/1971 | Arsenian | 482/71 |
| 3,612,519 | 10/1971 | Larson | 482/147 |
| 3,911,907 | 10/1975 | Smith, Jr. | 482/147 |
| 4,200,282 | 4/1980 | Agygos | 482/147 |
| 4,638,996 | 1/1987 | Simjian | 482/147 |
| 4,799,475 | 1/1989 | Iams et al. | 482/147 |
| 4,846,463 | 7/1989 | Kleinnibbelink | 482/171 |
| 4,953,858 | 9/1990 | Zalli | 482/71 |

*Primary Examiner*—Richard J. Apley
*Assistant Examiner*—Jerome Donnolly
*Attorney, Agent, or Firm*—Leon Gilden

[57] ABSTRACT

An exercise apparatus is arranged to include a rotatable support pad having an underlying wheel support, to include a positioning leg extending between the pad and a support shaft to rotatably mount the pad about the support shaft, with handles mounted to the support plate at a periphery of the support plate extending from the support plate, whereupon an individual is positioned upon the pad and simultaneously rotates about the support shaft while grasping the handles.

1 Claim, 4 Drawing Sheets

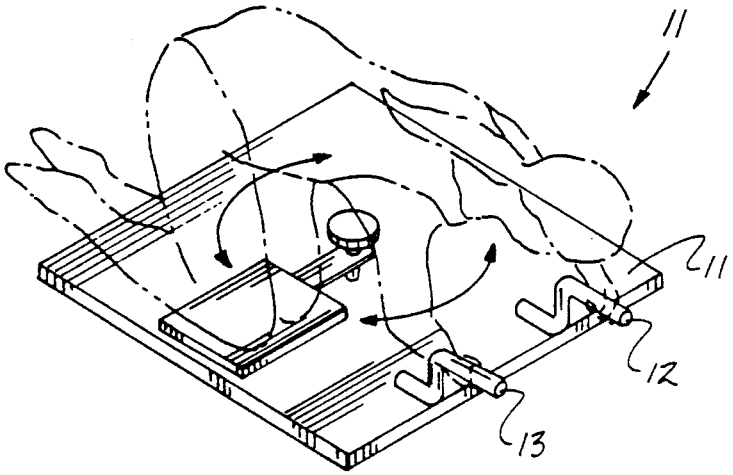
FIG 1
FIG 2
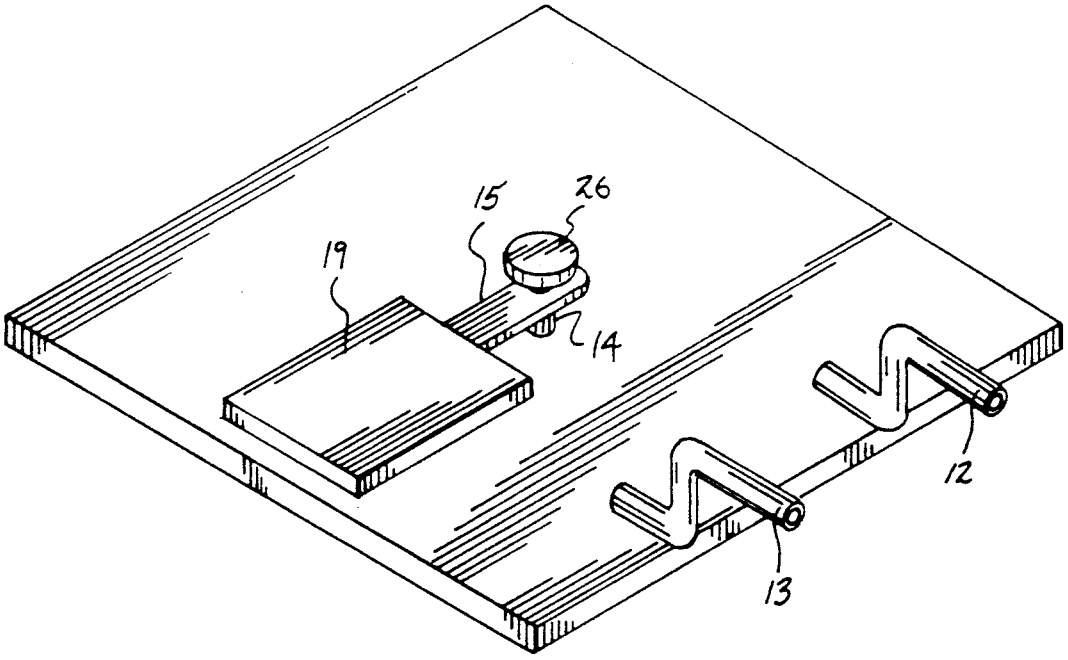

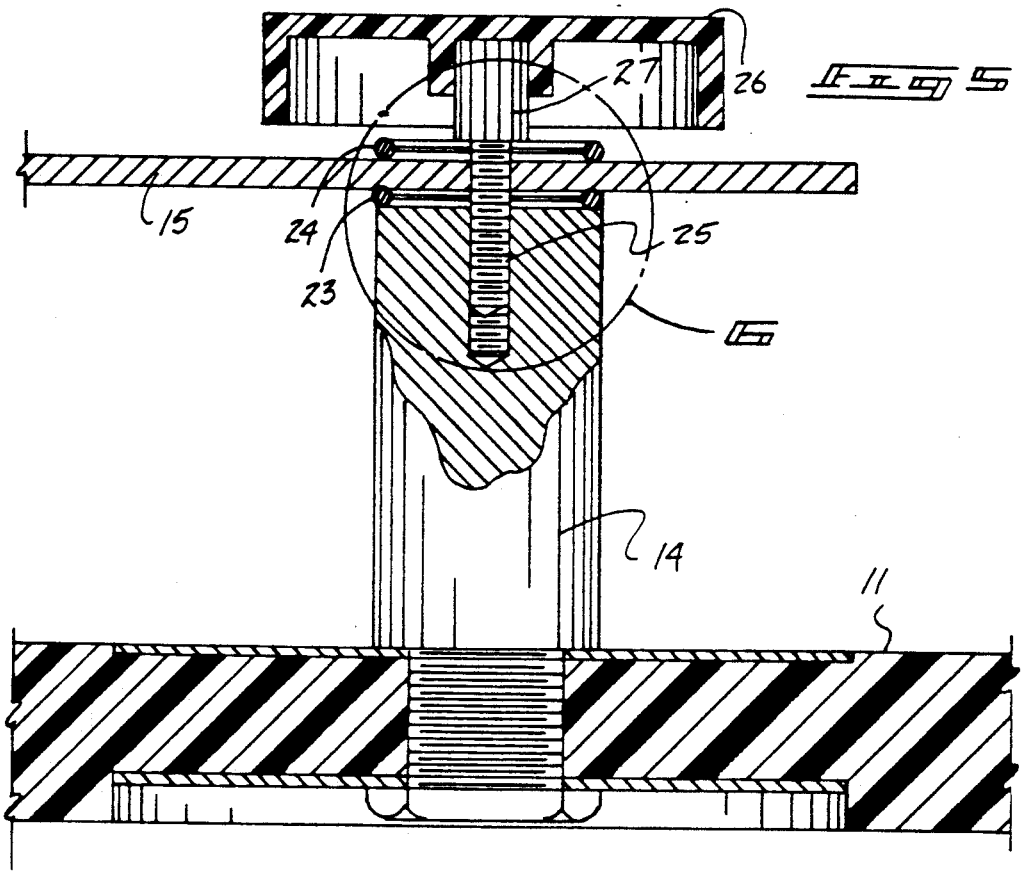
FIG 5
FIG 6
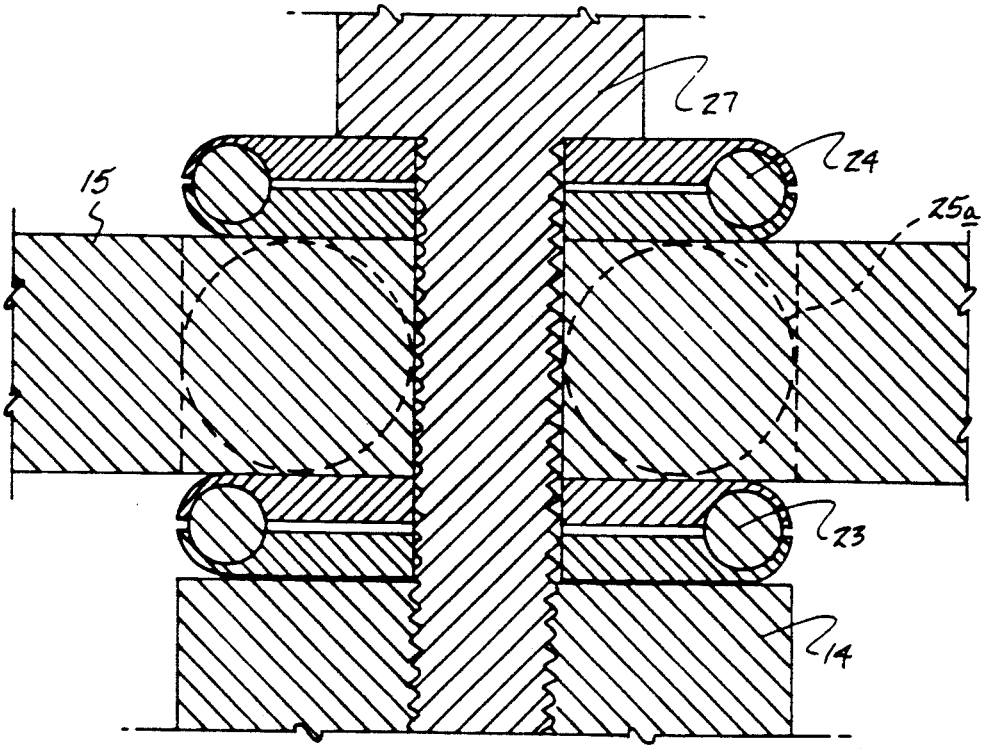

ABDOMINAL EXERCISE APPARATUS

BACKGROUND OF THE INVENTION

1. Field of the Invention

The field of invention relates to exercise apparatus, and more particularly pertains to a new and improved abdominal exercise apparatus wherein the same is arranged to improve abdominal tone and strength.

2. Description of the Prior Art

Abdominal apparatus of various types have been utilized in the prior art and exemplified by the U.S. Pat. Nos. 5,046,726; 5,050,875; 4,736,946; and 5,005,832.

The instant invention attempts to overcome deficiencies of the prior art by providing for an exercise apparatus arranged to accommodate an individual thereon to provide for continuous aerobic and abdominal exercise.

SUMMARY OF THE INVENTION

In view of the foregoing disadvantages inherent in the known types of exercise apparatus now present in the prior art, the present invention provides an abdominal exercise apparatus wherein the same is arranged to rotatably mount an individual's torso relative to a support plate while positioning the arms in a securing manner relative to handles. As such, the general purpose of the present invention, which will be described subsequently in greater detail, is to provide a new and improved abdominal exercise apparatus which has all the advantages of the prior art exercise apparatus and none of the disadvantages.

To attain this, the present invention provides an exercise apparatus arranged to include a rotatable support pad having an underlying wheel support, to include a positioning leg extending between the pad and a support shaft to rotatably mount the pad about the support shaft, with handles mounted to the support plate at a periphery of the support plate extending from the support plate, whereupon an individual is positioned upon the pad and simultaneously rotates about the support shaft while grasping the handles.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved abdominal exercise apparatus which has all the advantages of the prior art exercise apparatus and none of the disadvantages.

It is another object of the present invention to provide a new and improved abdominal exercise apparatus which may be easily and efficiently manufactured and marketed.

It is a further object of the present invention to provide a new and improved abdominal exercise apparatus which is of a durable and reliable construction.

An even further object of the present invention is to provide a new and improved abdominal exercise apparatus which is susceptible of a low cost of manufacture with regard to both materials and labor, and which accordingly is then susceptible of low prices of sale to the consuming public, thereby making such abdominal exercise apparatus economically available to the buying public.

Still yet another object of the present invention is to provide a new and improved abdominal exercise apparatus which provides in the apparatuses and method of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a pat of the disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the invention.

FIG. 2 is an enlarged isometric illustration of the invention.

FIG. 5 is an orthographic view, partially in section, of the support shafts of the invention mounted to the support plate.

FIG. 6 is an orthographic view of section 6 as set forth in FIG. 5.

DESCRIPTION OF THE PREFERRED EMBODIMENT

Figure 3:
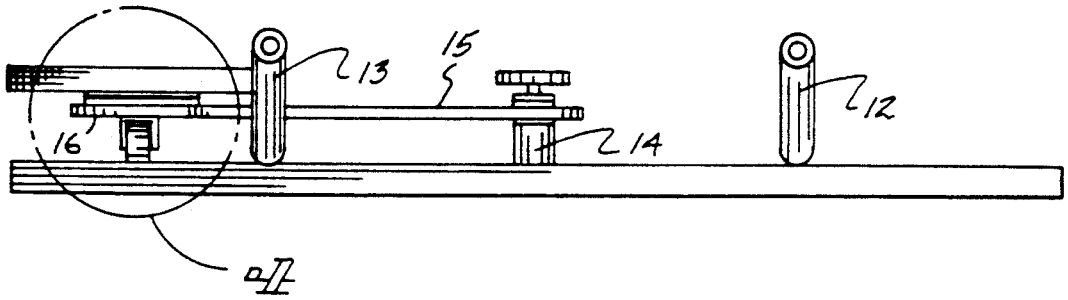
FIG. 3 is an orthographic end view of the invention.

With reference now to the drawings, and in particular to FIGS. 1 to 8 thereof, a new and improved abdominal exercise apparatus embodying the principles and concepts of the present invention and generally designated by the reference numeral 10 will be described.

More specifically, the abdominal exercise apparatus 10 of the instant invention essentially comprises a rigid support plate 11 having an outer perimeter, with respective first and second legs 12 and 13 respectively that are parallel relative to one another and project beyond the outer perimeter. A support shaft 14 is orthogonally and medially mounted fixedly of the support plate 11, and includes a positioning leg 15 having a first end rotatably mounted relative to the support shaft and orthogonally oriented relative to the support shaft. A positioning leg second end integrally is secured to a mounting plate 16 in a parallel relationship. An axle 17 is orthogonally mounted and secured to the mounting plate 16 directed medially thereof, with a wheel housing 18 mounted to the axle 18 below the mounting plate interposed between the mounting plate and the support plate, with a wheel member 22 rotatably mounted within the wheel housing 18 for rolling engagement with the support plate 11. A support pad 19 is provided, having a support pad base plate 20 secured to the mounting plate coextensive with the mounting plate to a surface thereof for supporting an individual thereon, in a manner as indicated in FIG. 1.

In this manner, an individual rests an individual's knees upon the pad 19 while simultaneously grasping the first and second handles 12 and 13. An individual then effects rotation of the mounting pad about the support shaft 14 to effect an abdominal as well as back exercise procedure.

Figure 4:
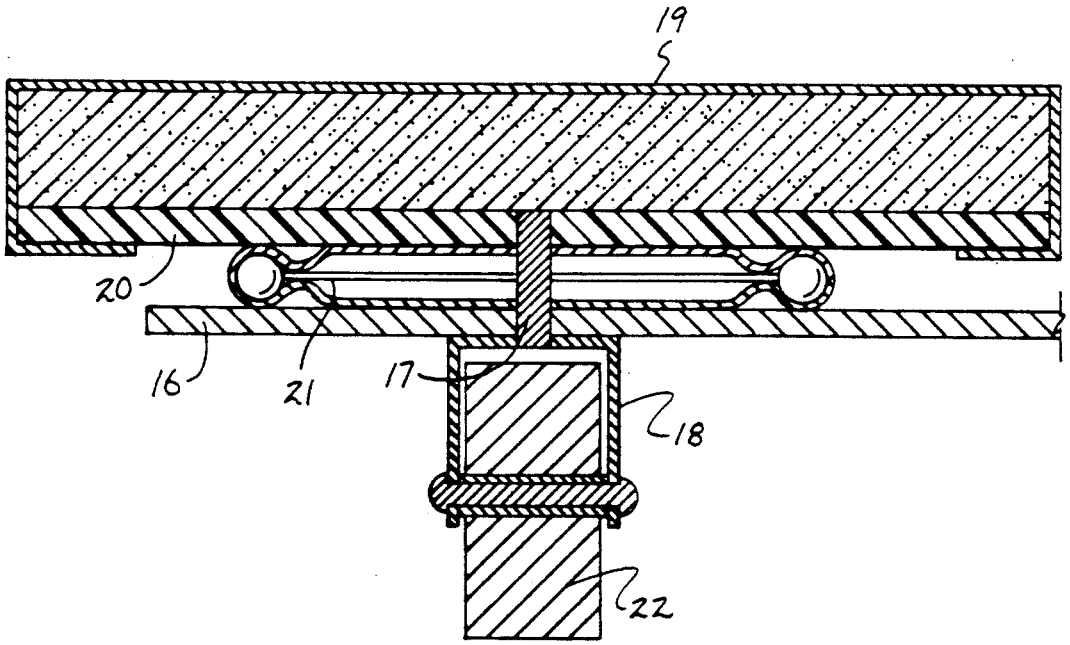
FIG. 4 is an enlarged cross-sectional view of section 4 as set forth in FIG. 3.

FIG. 4 indicates a roller bearing 21 interposed between a support pad base plate 20 and the mounting plate 16. The support pad base plate 20 coextensively mounts the pad thereon to permit rotation of the support pad relative to the mounting plate 16.

The FIGS. 5 and 6 indicates the support shaft 14 having a threaded lock rod 25 directed coaxially of the support shaft 14, with a first positioning leg bearing 23 interposed between the positioning leg 15 and the mounting post 14. A second positioning leg bearing 24 is interposed between the positioning leg 15 and a handle shank 20 of a lock rod handle 26 fixedly mounted to the lock rod 25, whereupon threaded projection of the lock rod into the support shaft 14 effects the tightening of the first and second positioning leg bearings 23 and 24 to provide for additional friction and resistance relative to rotation of the mounting plate 16 about the support shaft 14.

Figure 7:
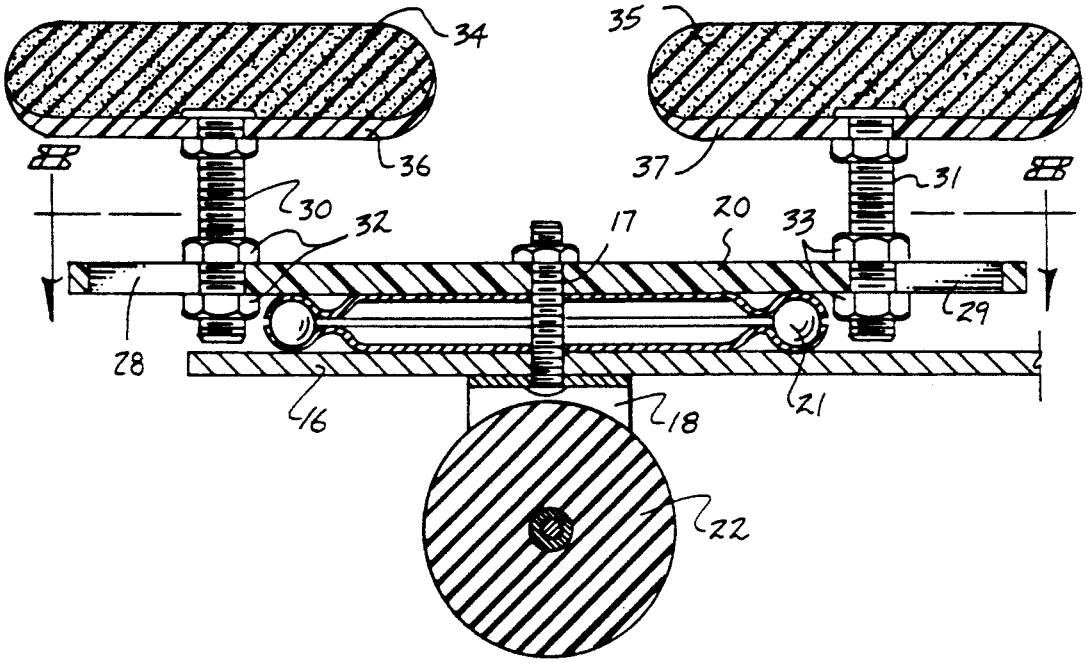
FIG. 7 is an orthographic view of a modified support pad structure of the invention.
Figure 8:
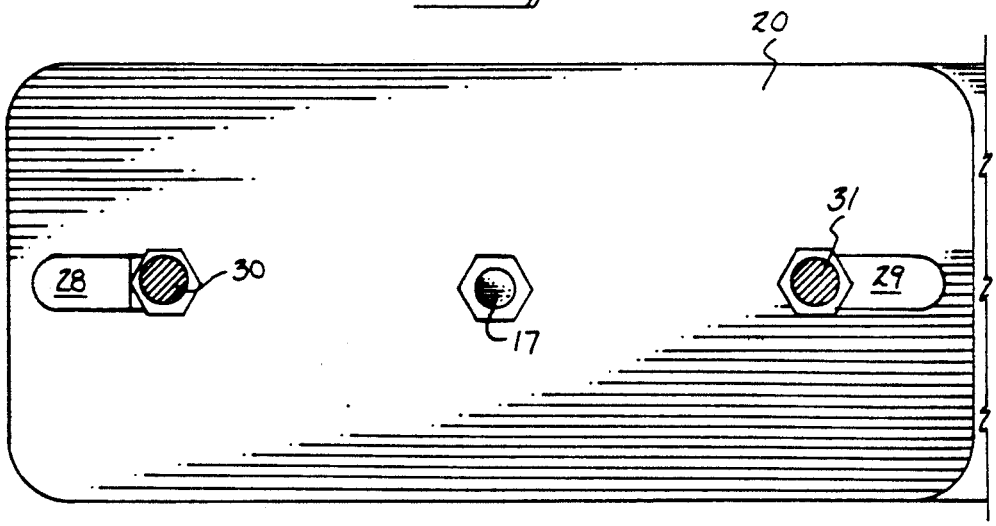
FIG. 8 is an orthographic view, taken along the lines 8—8 of FIG. 7 in the direction indicated by the arrows.

The FIGS. 7 and 8 indicates a modified support pad structure, wherein the mounting plate 16 and the roller bearing 21 includes a base plate positioned upon the roller bearing 21, having respective first and second slots 28 and 29 that are longitudinally aligned relative to one another, with respective first and second slot lugs 30 and 31 parallel relative to one another and orthogonally oriented relative to the base plate, and threadedly directed through the first and second slots 28 and 29 for providing for spatial adjustment of the first and second slot lugs 30 and 31 relative to one another. First and second fasteners 32 and 33 are secured to the respective first and second lugs 30 and 31 relative to the respective first and second slots 28 and 29. A first pad 34 and a second pad 35 include respective first an second pad plates 36 and 37 that in turn are fixedly secured to the respective first and second lugs 30 and 31 for positioning the individual's knees upon the respective first and second pads 34 and 35. It should be noted that the first and second fasteners 32 and 33 are mounted upon opposed sides of respective first and second lugs 30 and 31 in their securement to the base plate 20.

Optional roller bearing **25*a* is indicated in FIG. 6 for use within positioning leg 15 in surrounding relationship to lock rod 25 to prevent binding of the lock rod 25 through positioning leg 15**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to ne skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An abdominal exercise apparatus, comprising, a rigid support plate, the support plate having an outer perimeter and a first handle leg and a second handle leg arranged in a parallel relationship relative to one another and fixedly mounted to the support plate extending beyond the outer perimeter, with a support shaft oriented orthogonally and medially of the support plate and fixedly mounted to the support plate and spaced an equal distance relative to the first handle leg and the second handle leg, with the positioning leg having a positioning leg first end rotatably mounted to the support shaft and a positioning leg second end, a mounting plate fixedly mounted to the positioning leg second end, with the mounting plate and the positioning leg arranged in a parallel relationship relative to one another, and the mounting plate having an axle orthogonally directed medially of the mounting plate, with a wheel housing mounted to the axle below the mounting plate interposed between the mounting plate and the support plate, and the wheel housing having a wheel member rotatably mounted to the wheel housing for rotative engagement with the support plate, and a base plate, the base plate having a roller bearing interposed between the base plate and the axle rotatably mounting the base plate relative to the mounting plate, and the support shaft includes a threaded lock rod coaxially and threadedly directed into the support shaft, with a first positioning leg bearing interposed between the support shaft and the positioning leg, and a second positioning leg bearing interposed between the positioning leg and a handle shank, with the handle shank having a handle mounted to the handle shank, and the handle shank rotatably directed onto the threaded lock rod to effect frictional engagement of the first positioning leg bearing and the second positioning leg bearing relative to the support shaft, and the base plate includes a first slot and a second slot, the first slot and the second slot arranged in a longitudinally aligned relationship on opposed sides of the axle, and a first slot lug and a second slot lug arranged in a parallel relationship relative to one another, with the first slot lug directed through the first slot and the second slot lug directed through the second slot, with first fasteners directed on opposed sides of the base plate and mounted to the first slot lug to adjustably secure the first slot lug relative to the first slot, and second fasteners directed to the second slot lug on opposed sides of the base plate to adjustably secure the second slot relative to the second slot, and a first pad plate fixedly and orthogonally mounted to the first slot lug and a second pad plate mounted to the second slot lug, wherein the first pad plate and the second pad plate are spaced above the base plate, and a first pad mounted to the first pad plate, and a second pad mounted to the second pad plate for cushioned accommodation of an individual's knees upon the first pad plate and the second pad plate.

* * * * *